US005416567A

United States Patent [19]

Toyoshima et al.

[11] Patent Number: 5,416,567

[45] Date of Patent: May 16, 1995

[54] DEVELOPING DEVICE AND A DEVELOPING METHOD HAVING A CONDUCTIVE MEMBER UPSTREAM OF IMAGE DATA FORMING MEMBER

[75] Inventors: Tetsuro Toyoshima, Nara; Tetsuyuki Ueda, Kitakatsuragi; Atsushi Inoue, Ikoma; Taisuke Kamimura, Kitakatsuragi; Hideaki Fujita; Takayuki Yamanaka, both of Tenri, all of Japan

[73] Assignee: Sharp Kabushiki Kaisha, Osaka, Japan

[21] Appl. No.: 85,204

[22] Filed: Jun. 29, 1993

[30] Foreign Application Priority Data

| | | | |
|---|---|---|---|
| Jun. 30, 1992 | [JP] | Japan | 4-171381 |
| Mar. 25, 1993 | [JP] | Japan | 5-066482 |
| Apr. 7, 1993 | [JP] | Japan | 5-080561 |

[51] Int. Cl.[6] ..... G03G 15/06

[52] U.S. Cl. ..... 355/259; 118/653; 355/245

[58] Field of Search ..... 355/245, 246, 259; 118/653, 656; 222/DIG. 1

[56] References Cited

U.S. PATENT DOCUMENTS

| | | | |
|---|---|---|---|
| 3,929,098 | 12/1975 | Liebman | 355/253 X |
| 3,997,688 | 12/1976 | Gundlach et al. | 427/25 |
| 4,036,175 | 7/1977 | Phillips et al. | 355/251 X |
| 4,378,158 | 3/1983 | Kanbe | 355/259 |
| 4,669,852 | 6/1987 | Tajima et al. | 118/653 X |
| 4,686,934 | 8/1987 | Kohyama | 118/656 X |
| 4,885,223 | 12/1989 | Enoki et al. | 118/656 X |
| 5,017,967 | 5/1991 | Koga | 355/259 X |
| 5,086,728 | 2/1992 | Kinoshita | 118/653 |
| 5,182,601 | 1/1993 | Hodoshima et al. | 355/245 X |
| 5,183,964 | 2/1993 | Stelter et al. | 118/653 |
| 5,255,057 | 10/1993 | Stelter et al. | 355/246 |

FOREIGN PATENT DOCUMENTS

| | | |
|---|---|---|
| 58-32375 | 7/1983 | Japan . |
| 1-31605 | 6/1989 | Japan . |

OTHER PUBLICATIONS

K. Yanagida et al., "Toner Flying Mechanism of Single-Component Nonmagnetic Gap Development", J. Imaging Technology, vol. 15, No. 4, Aug. 1989, pp. 178–182.

European Search Report.

*Primary Examiner*—William J. Royer

*Attorney, Agent, or Firm*—David G. Conlin; Robert F. O'Connell; Kevin J. Fournier

[57] ABSTRACT

A developing device for developing, by using a developer, a latent image formed on a surface of an image data forming member including a developer accommodating section for accommodating the developer; a first developer retaining member for receiving the developer from the developer accommodating section and transporting the developer; a second developer retaining member for receiving the developer from the first developer retaining member and making the developer adhere to the latent image formed on the image data forming member; a conductive member opposed to the second developer retaining member with an appropriate space interposed therebetween; a first voltage applying member for applying a voltage between the first developer retaining member and the second developer retaining member; a second voltage applying member for applying a voltage between the second developer retaining member and the surface of the image data forming member; and a third voltage applying member for applying a voltage between the second developer retaining member and the conductive member in order to form an electric field in the space therebetween.

19 Claims, 9 Drawing Sheets

DEVELOPING DEVICE AND A DEVELOPING METHOD HAVING A CONDUCTIVE MEMBER UPSTREAM OF IMAGE DATA FORMING MEMBER

BACKGROUND OF THE INVENTION

1. Field of the Invention

The present invention relates to a developing device and a developing method for use in an image forming apparatus such as a copier, a laser printer, a facsimile apparatus and the like, for forming an image in an electrophotographic system; and in particular to a developing device and a developing method for visualizing an electronic latent image such as a latent charge image and an electrostatic latent image formed on a surface of an image data forming member by use of a developer.

2. Description of the Related Art

In this specification, the term "develop" means visualizing an electronic latent image formed on a surface of an image data forming member by making a developer formed of electrically charged colored particles adhere to such an electronic latent image. Examples of the electronic latent image are a conductive latent image, a latent charge image on photoconductive particles and an electrostatic latent image. Such a developing system will be described using as an example of an electrostatic latent image formed on a photoconductive member having a photoconductive layer thereon.

Developing mainly includes three steps: (1) electrically charging toner particles, (2) transporting the toner particles to a developing region, and (3) making the toner particles adhere to an electrostatic latent image. A practical developing process depends on the type of the developer. The electrophotographic system is mainly classified into a dry developing system and a wet developing system. The dry developing system is further classified into two systems: one system in which a two-component developer is used containing a toner formed of a resin mixed with a colorant and a carrier formed of magnetic iron powders and the like; and another system in which a monocomponent developer formed only of a toner is used.

In the system using a two-component developer, particles of the toner and particles of the carrier are first stirred in a developer chamber, thereby charging the toner and the carrier with opposite polarities to each other by friction. The toner particles which adhere to surfaces of the carrier particles are transported to a developing region by a developer retaining member (for example, a developer roller). The system using a two-component toner is further classified into several different systems depending on the carrier for transporting the toner: a magnetic brush development system using a carrier formed of iron powders, a cascade development system using a carrier formed of a glass material or a nonferrous metal, and the like.

In the system using a monocomponent developer, a blade is provided so as to be opposed to the developer retaining member. The toner is charged by friction with the blade while being transported by the developer retaining member toward a developing region. The system using a monocomponent toner is further classified into several different systems: a powder cloud development system, a contact development system, a jumping development system, a magnedynamic process and the like. In the powder cloud development system, the toner particles are used in an aerosol state. In the contact development, the toner particles are directly contacted on an electrostatic latent image. In the jumping development system, the toner particles are electrically charged and jump across an air gap toward an electrostatic latent image with no direct contact. In the magnedynamic process, a magnetic, conductive toner is contacted on an electrostatic latent image.

In a system using a monocomponent toner, step (1) of electrically charging the toner has an inconvenience in that the toner particles are not sufficiently charged in a short period of time by only the friction among toner particles. In order to compensate for this inconvenience, a regulating member is mechanically put into direct contact with a roller-like developer retaining member so as to charge the toner particles by friction between the developer retaining member and the regulating member, among the toner particles, and between the regulating member and the toner particles. Such a process involves the following problems.

(a) The grain size of the toner particles is changed by the contact between the toner particles and the regulating member.

(b) The toner particles flocculate by the contact with the regulating member.

For step (2) of transporting the toner particles to a developing region and step (3) of making the toner particles adhere to an electrostatic latent image, the following system is known. A developing retaining member is directly contacted with the photoconductive member so as to adhere the toner particles on the electrostatic latent image (contact development system for a monocomponent developer). According to this system, there is a problem in that the toner particles easily adhere to an area of the surface of the photoconductive member where no image is to be formed.

The jumping development system which is a practical example of a non-contact development system for a monocomponent developer is described in Japanese Patent Publication No. 58-32375. According to this system, the toner particles are electrically charged and jump across an air gap toward an electrostatic latent image with no direct contact as mentioned above. The above problem is solved by this system although only a magnetic toner can be used. The jumping development system has, for example, the following features: (a) the toner particles are uniformly charged by use of a regulating member formed of a magnetic material; and (b) the thickness of a toner layer is reduced by the magnetic force applied on the developer retaining member.

The Jumping development system has a problem in that it is difficult to color the toner particles cyan, magenta, yellow and the like, since a magnetic toner must be used. Accordingly, it is difficult to use a developing device for this system with a color electrophotographic apparatus.

In a system using a two-component developer, a developer containing toner particles and carrier particles in a mixed state is used, and the toner particles are consumed in a larger amount than the carrier particles. The difference in the amount consumed between the toner particles and the carrier particles is increased with the progress of the developing process. Accordingly, this system has the following defects: (a) the image density fluctuates in accordance with the change in the mixture ratio of the toner particles and the carrier particles along the time passage; and (b) image quality is declined by the deterioration in the quality of the carrier particles. These defects cause the following problems.

(1) Maintenance for exchanging the developer is necessary.

(2) Since the toner particles are contacted on an area of the photoconductive member where no image is to be formed by the developer retaining member as in a monocomponent contact developing system, the toner particles easily adhere to such an area.

In a system using a monocomponent developer, the above-mentioned change in the grain size and the flocculation cause fluctuation in the amount of electricity of the charged toner particles and also blur an area of the photoconductive member where no image is to be formed. Further, in this system, the toner is charged by a friction method using friction between the toner particles and a charging member (for example, a blade formed of a resin), a charge injection method by which charges are directly supplied from an electrode to the toner particles, or the like. In order to sufficiently charge the toner particles, it is necessary to reduce the thickness of the toner layer. However, the reduction in the thickness of the toner layer reduces the amount of toner supplied to the photoconductive member, resulting in difficulties in obtaining a sufficient image density.

Recently, use of toner particles having a smaller grain size than that of conventional toner particles has been proposed in order to enhance the resolution of an image formed with toner. However, as is described in "Effects of Small-grain-size Toner on Image Quality", by Naomitsu Yoshimura, *Electrophotography Japan*, Vol. 31, No. 1 (1992), pp. 82–86, the amount of electricity of the charged toner particles per unit mass, namely, the toner charge-to-mass ratio ($\mu C/g$) is increased in the case of the toner particles having the smaller grain size. Accordingly, in a system using a monocomponent developer, toner particles are repelled by each other, thereby reducing the toner density of the toner layer. This phenomenon causes difficulties in obtaining a sufficient image density. In order to enhance the image density, it is necessary to increase the grain size of the toner particles or the amount of the toner. An increase in the grain size will counteract the use of the toner particles having the smaller grain size. A simple increase in the amount of the toner supplied to the developer retaining member will raise the thickness of the toner layer, and thus cause toner dropping or blur on an image. These phenomena decrease the resolution.

In a system using a two-component developer, the toner particles and the carrier particles are sufficiently stirred in a developer chamber. Thus, the toner particles are sufficiently and uniformly charged. Moreover, since the toner is transported on the developer retaining member after being charged, a sufficient amount of toner is transported so as to obtain an image with a high density. However, in this system, the developer contains toner particles which are not sufficiently charged because the amount of electricity of the charged toner is changed along the time passage by toner consumption. Accordingly, there is an undesirable possibility of reduction and non-uniformity in the image density. In order to maintain the image density at a constant level, the mixture ratio of the toner particles and the carrier particles in the developer is required to be kept constant. This necessitates a complex structure of the entire developing device.

In the case where the developing system using a monocomponent developer formed of a non-magnetic toner is used in a color electrophotographic apparatus, the toner particles are not sufficiently charged in a short period of time only by the friction among the toner particles. In order to compensate for this inconvenience, the ratio in the circumferential velocity of the developer retaining member such as a developer roller with respect to that of the photoconductive member is required to be increased so as to frequently cause friction. Such an increase in the above ratio involves a defect of possibly lowering the image density.

One of conceivable reasons of the above-mentioned problems is that there exist ill-charged toner particles among well-charged toner particles on the developer retaining member for some reason, and both of these toner particles adhere directly to an area of the photoconductive member from the developer retaining member.

SUMMARY OF THE INVENTION

A developing device according to the present invention for developing, by using a developer, a latent image formed on a surface of an image data forming member includes a developer accommodating section for accommodating the developer; a first developer retaining member for receiving the developer from the developer accommodating section and transporting the developer; a second developer retaining member for receiving the developer from the first developer retaining member and making the developer adhere to the latent image formed on the image data forming member; a conductive member opposed to the second developer retaining member with an appropriate space interposed therebetween; a first voltage applying member for applying a voltage between the first developer retaining member and the second developer retaining member; a second voltage applying member for applying a voltage between the second developer retaining member and the surface of the image data forming member; and a third voltage applying member for applying a voltage between the second developer retaining member and the conductive member in order to form an electric field in the space therebetween.

In a preferred embodiment of the present invention, the first voltage applying member applies one of a DC voltage, an AC voltage and a voltage formed by superposition of a DC voltage and an AC voltage.

In a preferred embodiment of the present invention, the second voltage applying member applies one of a DC voltage, an AC voltage and a voltage formed by superposition of a DC voltage and an AC voltage.

In a preferred embodiment of the present invention, the third voltage applying member applies one of a DC voltage, an AC voltage and a voltage formed by superposition of a DC voltage and an AC voltage.

In a preferred embodiment of the present invention, the developer is a monocomponent developer formed of a non-magnetic toner.

In a preferred embodiment of the present invention, the developer is a two-component developer containing a non-magnetic toner.

In a preferred embodiment of the present invention, at least one of the first developer retaining member and the second developer retaining member is a roller.

In a preferred embodiment of the present invention, at least one of the first developer retaining member and the second developer retaining member is a belt.

In a preferred embodiment of the present invention, the conductive member is a roller.

In a preferred embodiment of the present invention, the conductive member is a plate having an arched cross section.

In a preferred embodiment of the present invention, the developing device further includes at least one blade opposed to the first developer retaining member, the blade forming the developer transported by the first developer retaining member into a thin layer.

In a preferred embodiment of the present invention, the developer accommodating section includes a stirring member for stirring the developer.

Alternatively, a developing device according to the present invention for developing, by using a developer, a latent image formed on a surface of an image data forming member includes a developer accommodating section for accommodating the developer; a developer retaining member for receiving the developer from the developer accommodating section and transporting the developer to the latent image formed on the image data forming member; an electrode provided at a position which is downstream from the developer accommodating section and upstream from the image data forming member in a direction in which the developer is transported, the electrode being opposed to the developer retaining member; and a voltage applying member for applying a DC voltage between the electrode and the developer retaining member so that the electric sign of the electrode be identical to that of the toner charge.

In a preferred embodiment of the present invention, the voltage applying member applies an AC voltage as well as the DC voltage between the electrode and the developer retaining member.

In a preferred embodiment of the present invention, the electrode is a conductive blade which is pressed on a surface of the developer retaining member.

In a preferred embodiment of the present invention, the developer contains at least a toner having a resistivity of approximately $10^{13}$ Ωcm at the maximum.

In a preferred embodiment of the present invention, the blade is pressed by a force of approximately 1.5 kgf/cm$^2$ at the maximum..

A developing method according to the present invention for developing, by using a developer, a latent image formed on a surface of an image data forming member includes a first step of transporting a developer by a first developer retaining member to a second developer retaining member; and a second step of transporting the developer by the second developer retaining member to the surface of the image data forming member so as to;adhere the developer on the latent image thereon. At least in the first step, a voltage is applied between the first developer retaining member and the second developer retaining member; and, at least in the second step, a voltage is applied between the second developer retaining member and the surface of the image data forming member and between the second developer retaining member and a conductive member opposed to the second developer retaining member with an appropriate space interposed therebetween.

Thus, the invention described herein makes possible the advantages of (1) providing a compact and highly reliable developing device for use in an electrophotographic apparatus in which either a black toner or a colored toner can be used and a developing method performed by such a developing device; (2) providing a developing device for obtaining a high density image with no problems such as blur, using a monocomponent developer and a developing method performed by such a developing device; and (3) providing a developing device for transporting a sufficient amount of a monocomponent developer on a developer retaining member without increasing the thickness of the layer of the developer and a developing method performed by such a developing device.

These and other advantages of the present invention will become apparent to those skilled in the art upon reading and understanding the following detailed description with reference to the accompanying figures.

DESCRIPTION OF THE PREFERRED EMBODIMENTS

Figure 2:
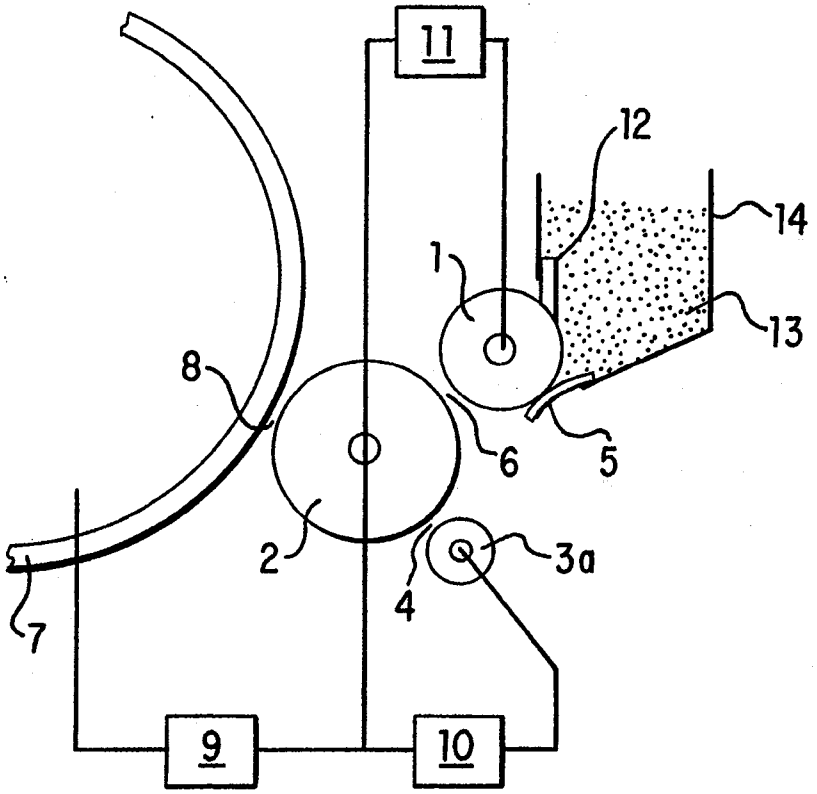
FIG. 2 is a view illustrating a construction of a developing device according to a second example of the present invention together with a photoconductive member.

Hereinafter, the present invention will be described by way of illustrating examples with reference to the accompanying drawings.

Example 1

A developing device according to a first example of the present invention will be described with reference to FIG. 1.

A monocomponent developer 13 formed only of a toner is supplied from a developer supply section (not shown) to a developer accommodating section 14 and charged by the following three types of friction: (1) friction between a developer roller 1 acting as a first developer retaining member and regulating members 5 and 12; (2) friction between the developer 13 and the regulating members 5 and 12; and (3) friction among particles of the developer 13. The developer 13 is then formed into a thin toner layer by the regulating member 5 or 12 and retained on a surface of the developer roller 1. The developer roller 1 may be rotated clockwise or counterclockwise in FIG. 1. When the developer roller 1 is rotated clockwise, the regulating member 5 forms the developer 13 into a thin toner layer; and when the developer roller 1 is rotated counterclockwise, the regulating member 12 forms the developer 13 into a thin toner layer. The developer 13 is then transported by the rotation of the developer roller i to another developer roller 2 acting as a second developer retaining member.

The developer rollers 1 and 2 are opposed to each other with a microscopic space 6 interposed therebetween. A DC voltage is applied between the developer rollers 1 and 2 by a voltage applying section thereby forming an electric field in the space 6. Accordingly, among all the particles of the developer 13 (hereinafter, referred to as the toner particles) on the developer roller 1, only the ones which are sufficiently charged are selected and moved to the developer roller 2. The toner particles which are not sufficiently charged are retained on the surface of the developer roller 1 and returned to the developer accommodating section 14 so as to be charged again. After the above-mentioned process is repeated a number of times, only the toner particles which are sufficiently charged are moved to the developer roller 2.

In the case where an AC voltage or a voltage obtained by superposition of a DC voltage and an AC voltage is applied between the developer rollers i and 2, the toner particles reciprocate in the space 6 and thus bump against one another in the thin toner layer on the developer roller 2. As a result, the potentials with which the toner particles are charged (hereinafter, referred to as the charging potentials of the toner particles) are uniformized. In other words, the toner particles which are not sufficiently charged are eliminated from the developer roller 2, and thus a toner layer formed only of toner particles charged with a uniform potential is formed. Further, the thickness of the toner layer is uniformized.

The toner particles which are moved to the developer roller 2 are retained thereon in a state of a thin toner layer and transported by the rotation of the developer roller 2. A conductive plate 3 having an arched cross section is provided so as to be opposed to the developer roller 2 with a microscopic space 4 interposed therebetween. A DC voltage, an AC voltage or a voltage obtained by superposition of a DC voltage and an AC voltage is applied between the developer roller 2 and the conductive plate 3 by a voltage applying section 10, thereby forming an electric field in the space 4. This electric field influences the toner particles in a similar manner with the electric field in the space 6, so as to further uniformize the charging potential of the toner particles on the developer roller 2.

It is also possible to control the charging potential of the toner particles by adjusting the voltage applying sections 10 and 11. In such adjustment, the voltage applied by each of the voltage applying sections 10 and 11 is adjusted in accordance with the size of the space 4 or 6, the potential with which the toner particles are to be charged, and the like.

Figure 1:
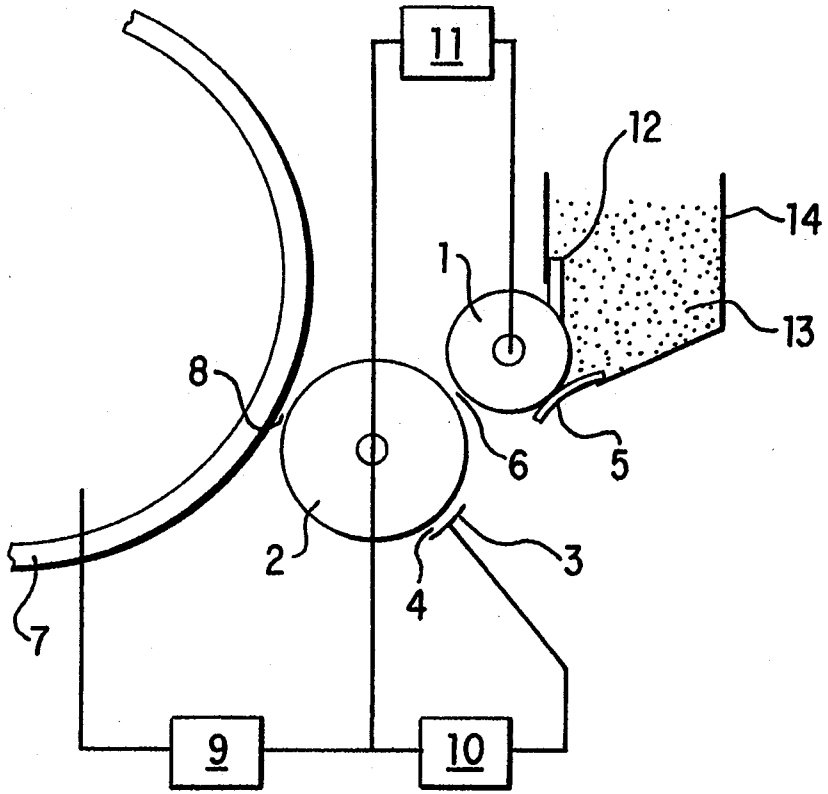
FIG. 1 is a view illustrating a construction of a developing device according to a first example of the present invention together with a photoconductive member.

The rotation direction of the developer roller 2 may be clockwise or counterclockwise in FIG. 1 and is determined independently from the rotation direction of the developer roller 1.

The toner particles on the developer roller 2 are transported toward a photoconductive drum 7. The photoconductive drum 7 has a photoconductive layer on a surface thereof formed of an organic material, an amorphous silicon material, an amorphous selenium material, a zinc oxide material, a cadmium sulfide material or the like. The developer roller 2 and the surface of the photoconductive drum 7 are opposed to each other with a microscopic space 8 interposed therebetween. A DC voltage is applied between the developer roller 2 and the photoconductive drum 7 by a voltage applying section 9, thereby forming an electric field in the space 8. By the influence of the electric field, the toner particles on the developer roller 2 are moved to the surface of the photoconductive drum 7 in correspondence with image data such as an electrostatic latent image formed on the photoconductive drum 7, so as to form a toner image. The image data is indicated by the existence or non-existence of a charge, potential difference among areas of the surface, or the like. In the case where a voltage obtained by superposition of a DC voltage and an AC voltage is applied by the voltage applying section 9, the charging potentials of the toner particles on the surface of the photoconductive drum 7 are uniformized in a similar manner as mentioned above.

As is apparent from the above description, due to the formation of the electric field in the spaces 6 and 4, a thin toner layer having a uniform thickness containing only toner particles charged with a sufficient, uniform potential is formed on the developer roller 2. Due to the uniformity in the charging potential and the thickness of the toner layer and also influenced by the electric field formed in the space 8, the charging potential of the toner particles and the thickness of the toner layer on the photoconductive drum 7 can both be uniform. As a result, images with a stable, uniform quality can be obtained.

Example 2

FIG. 2 illustrates a construction of a developing device according to a second example of the present invention.

The developing device according to the second example is distinct from that in the first example in that a conductive roller 3a is provided instead of the conductive plate 3.

Since the other sections and members are identical with those in the first example, description will be omitted. Needless to say, the function and the effects of the developing device according to the second example are the same as those in the first example.

Example 3

Figure 3:
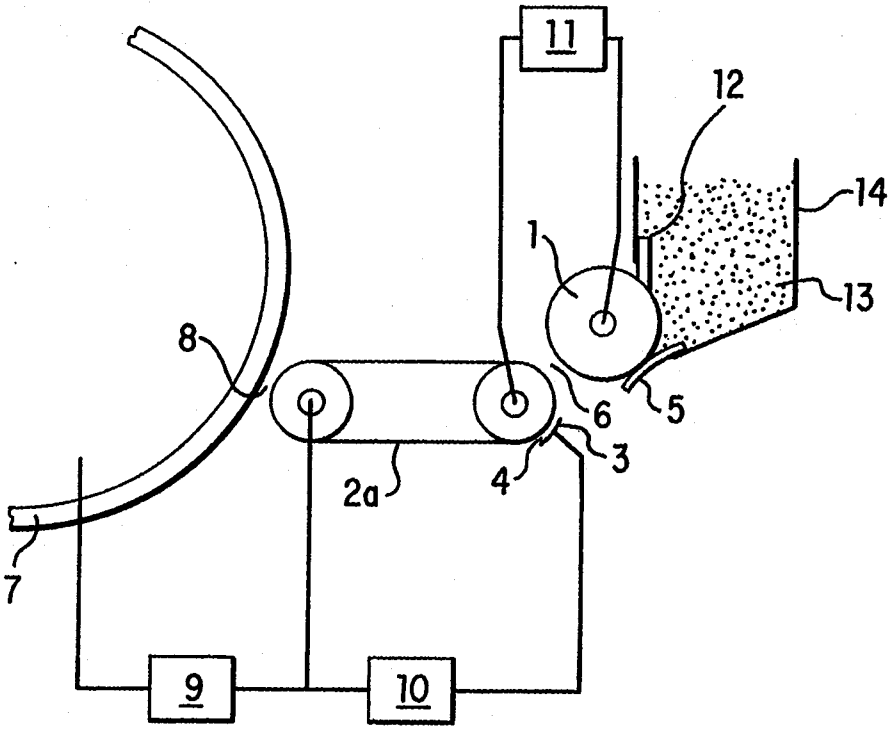
FIG. 3 is a view illustrating a construction of a developing device according to a third example of the present invention together with a photoconductive member.

FIG. 3 illustrates a construction of a developing device according to a third example of the present invention.

The developing device according to the third example is distinct from that in the first example in that a developer belt 2a is provided instead of the developer roller 2.

Since the other sections and members are identical with those in the first example, description will be omitted. Needless to say, the function and the effects of the developing device according to the third example are the same as those in the first example.

Example 4

Figure 4:
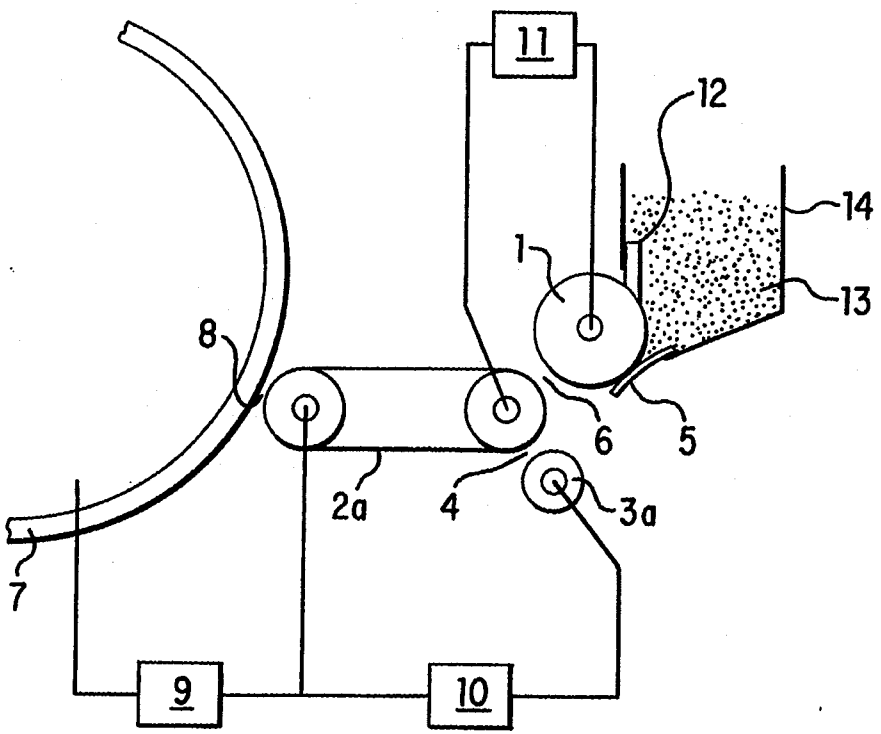
FIG. 4 is a view illustrating a construction of a developing device according to a fourth example of the present invention together with a photoconductive member.

FIG. 4 illustrates a construction of a developing device according to a fourth example of the present invention.

The developing device according to the fourth example is distinct from that in the first example in that a developer belt 2a and a conductive roller 3a are provided instead of the developer roller 2 and the conductive plate 3, respectively.

Since the other sections and members are identical with those in the first example, description will be omitted. Needless to say, the function and the effects of the developing device according to the fourth example are the same as those in the first example.

Figure 9A:
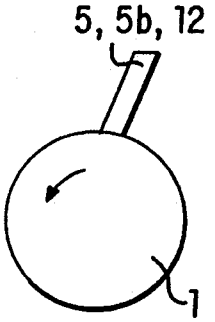
FIGS. 9A and 9B are views each illustrating an example of a regulating member or a doctor blade for use in a developing device according to the present invention.
Figure 9B:
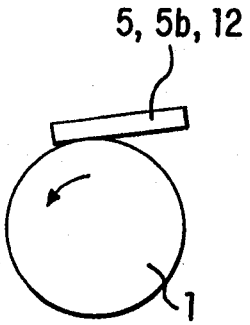

In the above four examples, the regulating members 5 and 12 may have other shapes. FIGS. 9A and 9B each illustrate an example of the shape of the regulating members 5 and 12 in the case when the regulating members 5 and 12 rotate counterclockwise in FIG. 1. The regulating members 5 and 12 may each be formed of a rubber-like elastic material or a resin.

Example 5

Figure 5:
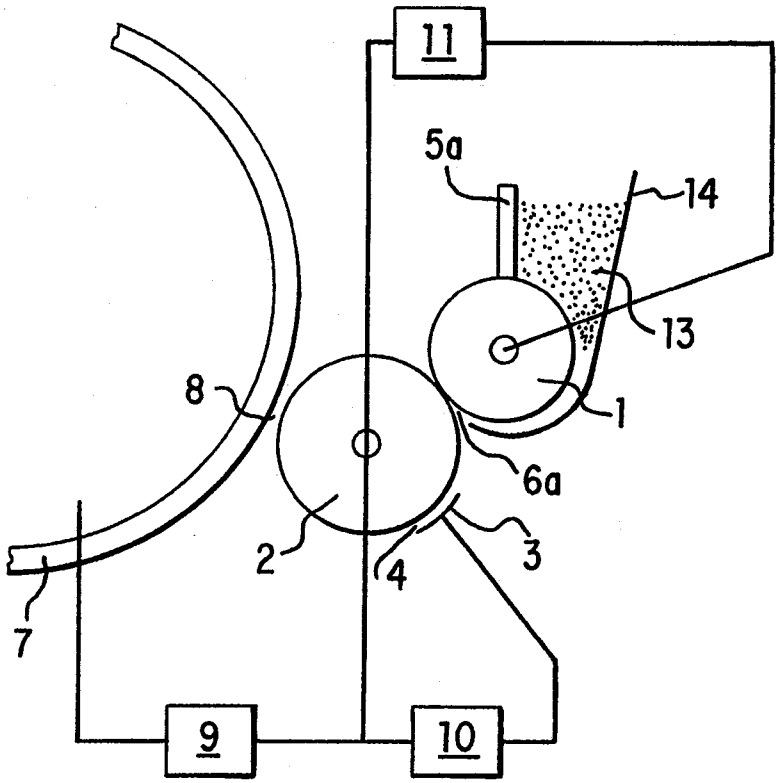
FIG. 5 is a view illustrating a construction of a developing device according to a fifth example of the present invention together with a photoconductive member.

A developing device according to a fifth example of the present invention will be described with reference to FIG. 5.

A monocomponent developer 13 formed only of a toner is supplied from a developer supply section (not shown) to a developer accommodating section 14 and charged by the following three types of friction: (1) friction among particles of the developer 13; (2) friction between the developer 13 and a regulating member 5a; and (3) friction between the developer 13 and a developer roller 1 acting as a first developer retaining member. Then, the developer 13 is retained on a surface of the developer roller 1. The developer roller 1 is rotated counterclockwise in FIG. 5 so as to transport the developer 13 to a developer roller 2 acting as a second developer retaining member. The toner is formed into a thin toner layer by the regulating member 5a.

Distinct from in the above four examples, the developer rollers 1 and 2 are in contact with each other at a region 6a. A DC voltage is applied between the developer rollers 1 and 2 by a voltage applying section 11, thereby forming an electric field in the region 6a. Accordingly, among all the toner particles on the developer roller 1, only the ones which are sufficiently charged are selected and moved to the developer roller 2. The toner particles which are not sufficiently charged are retained on the surface of the developer roller 1 and returned to the developer accommodating section 14 so as to be charged again. After the above-mentioned process is repeated a number of times, only the toner particles which are sufficiently charged are moved to the developer roller 2.

In the case where an AC voltage or a voltage obtained by superposition of a DC voltage and an AC voltage is applied between the developer rollers 1 and 2, the toner particles reciprocate in the region 6a and thus collide with one another in the thin toner layer on the developer roller 2. As a result, the charging potentials of the toner particles are uniformized. In other words, the toner particles which are not sufficiently charged are eliminated from the developer roller 2, and thus a toner layer formed only of toner particles charged with a uniform potential is formed. Further, the thickness of the toner layer is uniformized.

The toner particles which are moved to the developer roller 2 are retained thereon in a state of a thin toner layer and transported by the rotation of the developer roller 2. As is in the first example, a conductive plate 3 having an arched cross section is provided so as to be opposed to the developer roller 2 with a microscopic space 4 interposed therebetween. A DC voltage, an AC voltage or a voltage obtained by superposition of a DC voltage and an AC voltage is applied between the developer roller 2 and the conductive plate 3 by a voltage applying section 10, thereby forming an electric field in the space 4. This electric field influences the toner particles in a similar manner to the electric field in the region 6a, so as to further uniformize the charging potential of the toner particles on the developer roller 2. It is also possible to control the charging potential of the toner particles by adjusting the voltage applying section 10. In such an adjustment, the voltage applied by the voltage applying section 10 is adjusted in accordance with the size of the space 4, the potential with which the toner particles are to be charged, and the like.

The toner particles on the developer roller 2 are transported toward a photoconductive drum 7. As is the case in the above four examples, the photoconductive drum 7 has a photoconductive layer on a surface thereof formed of an organic material, an amorphous silicon material, an amorphous selenium material, a zinc oxide material, a cadmium sulfide material or the like. The developer roller 2 and the surface of the photoconductive drum 7 are opposed to each other with a microscopic space 8 interposed therebetween. A DC voltage is applied between the developer roller 2 and the photoconductive drum 7 by a voltage applying section 9, thereby forming an electric field in the space 8. By the influence of the electric field, the toner particles on the developer roller 2 are moved to the surface of the photoconductive drum 7 in correspondence with image data such as an electrostatic latent image formed on the photosensitive drum 7, so as to form a toner image. The image data is indicated by the existence or non-existence of a charge, potential difference among areas of the surface, or the like. In the case where an AC voltage or a voltage obtained by superposition of a DC voltage and an AC voltage is applied by the voltage applying section 9, the charging potentials of the toner particles are uniformized on the photoconductive drum 7 in a similar manner as mentioned above.

As is apparent from the above description, due to the voltage applying sections 10 and 11, a thin toner layer having a uniform thickness containing only toner particles charged with a sufficient, uniform potential is formed on the developer roller 2. Due to the uniformity in the charging potential and the thickness of the toner layer on the developer roller 2 and also influenced by the electric field formed in the space 8, the charging potential and the thickness of the toner layer can both be uniform. As a result, images with a stable, uniform quality can be obtained.

Example 6

Figure 6:
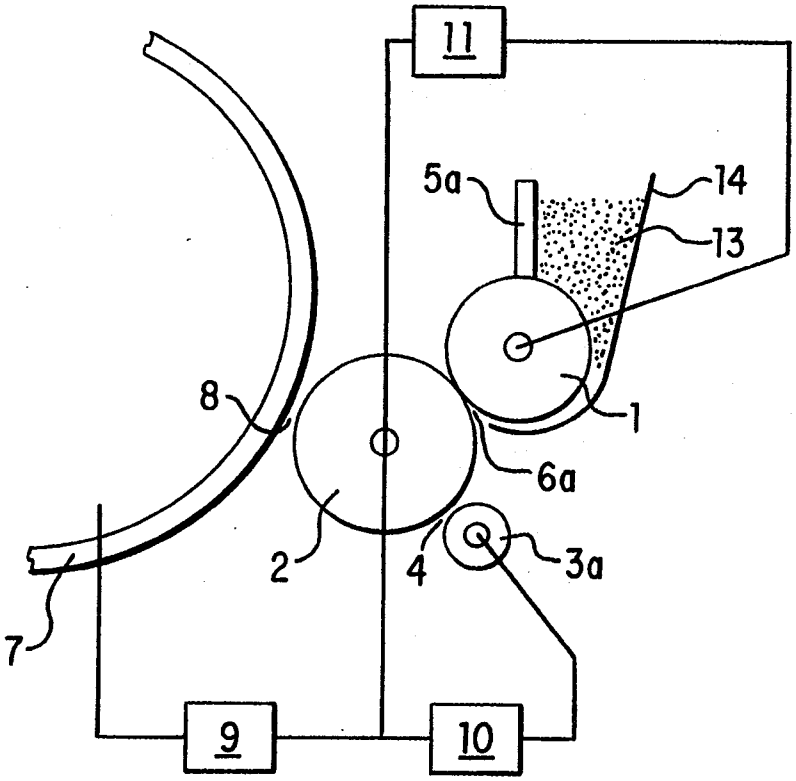
FIG. 6 is a view illustrating a construction of a developing device according to a sixth example of the present invention together with a photoconductive member.

FIG. 6 illustrates a construction of a developing device according to a sixth example of the present invention.

The developing device according to the sixth example is distinct from that in the fifth example in that a conductive roller 3*a* is provided instead of the conductive plate 3.

Since the other sections and members are identical with those in the fifth example, description will be omitted. Needless to say, the function and the effects of the developing device according to the sixth example are the same as those in the fifth example.

In the fifth and the sixth examples, the regulating member 5*a* is in contact with the developer roller 1. In the case where the monocomponent developer 13 is a magnetic toner, the regulating member 5*a* may be out of contact from the developer roller 1.

Example 7

A developing device according to a seventh example of the present invention will be described with reference to FIG. 7. In the seventh example, a two-component developer 16 containing toner particles and carrier particles is used.

The two-component developer 16 supplied to a developer accommodating section 14 is charged by friction among the toner particles and the carrier particles of the developer 16 and stirring by a mixer 15, then formed into a layer having a uniform thickness by a doctor blade 5*b*, and retained on a magnetic roller 1*a* acting as a first developer retaining member.

The magnetic roller 1*a* is opposed to a developer roller 2 acting as a second developer retaining member with a microscopic space 6*b* interposed therebetween. A DC voltage is applied between the magnetic roller 1*a* and the developer roller 2 by a voltage applying section 11, thereby forming an electric field in the space 6*b*. Influenced by the electric field, among all the toner particles of the developer 16, only the ones which are sufficiently charged are selected and moved to the developer roller 2. The carrier particles in the developer 16 are not moved. The toner particles which are not sufficiently charged are retained on a surface of the magnetic roller 1*a* and returned to the developer accommodating section 14 so as to be charged again. After the above-mentioned process is repeated a number of times, only the toner particles which are sufficiently charged are moved to the developer roller 2.

In the case where an AC voltage or a voltage obtained by superposition of a DC voltage and an AC voltage is applied between the magnetic roller 1*a* and the developer roller 2, the toner particles reciprocate in the space 6*b* and thus collide with one another in the layer on the developer roller 2. As a result, the charging potentials of the toner particles are uniformized. In other words, the toner particles which are not sufficiently charged are eliminated from the developer roller 2, and thus a toner layer formed only of toner particles charged with a uniform potential is formed on the developer roller 2. Further, the thickness of the toner layer is uniformized. Conventionally, a two-component developer has a problem in that the charging potential of the toner particles is reduced as the consumption of the toner along the time passage changes the capacity ratio of the carrier particles and the toner particles. In the developing device according to the seventh example of the present invention, such a problem does not occur.

Figure 7:
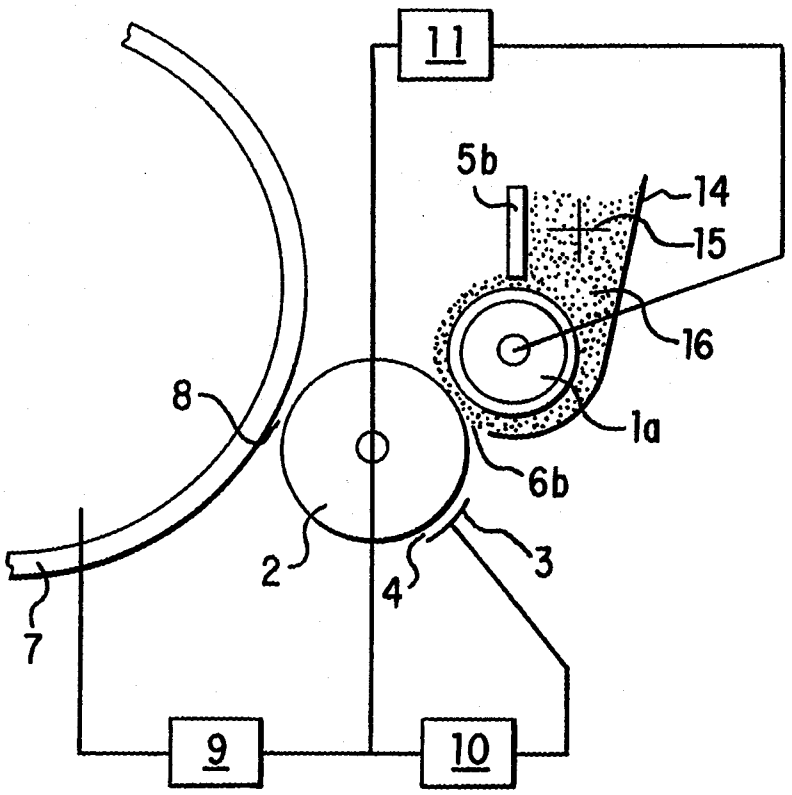
FIG. 7 is a view illustrating a construction of a developing device according to a seventh example of the present invention together with a photoconductive member.

The rotation direction of the magnetic roller 1*a* and the developer roller 2 may be clockwise or counterclockwise in FIG. 7 and determined independently from each other.

As in the first example, a conductive plate 3 having an arched cross section is provided so as to be opposed to the developer roller 2 with a microscopic space 4 interposed therebetween. A DC voltage, an AC voltage or a voltage obtained by superposition of a DC voltage and an AC voltage is applied between the developer roller 2 and the conductive plate 3 by a voltage applying section 10, thereby forming an electric field in the space 4. This electric field influences the toner particles in a similar manner with the electric field in the space 6*b*, so as to further uniformize the charging potential of the toner particles on the developer roller 2. It is also possible to control the charging potential of the toner particles by adjusting the voltage applying sections 10. In such an adjustment, the voltage applied by the voltage applying section 10 is adjusted in accordance with the size of the space 4, the potential with which the toner particles are to be charged, and the like.

The toner particles on the developer roller 2 are transported toward a photoconductive drum 7. As in the first example, the photoconductive drum 7 has a photoconductive layer on a surface thereof, formed of an organic material, an amorphous silicon material, an amorphous selenium material, a zinc oxide material, a cadmium sulfide material or the like. The developer roller 2 and the surface of the photoconductive drum 7 are opposed to each other with a microscopic space 8 interposed therebetween. A DC voltage is applied between the developer roller 2 and the photoconductive drum 7 by a voltage applying section 9, thereby forming an electric field in the space 8. By the influence of the electric field, the toner particles on the developer roller 2 are moved to the surface of the photoconductive drum 7 in correspondence with image data such as an electrostatic latent image formed on the photoconductive drum 7, so as to form a toner image. The image data is indicated by the existence or non-existence of a charge, potential difference among areas of the surface, or the like.. In the case where a voltage obtained by superposition of a DC voltage and an AC voltage is applied by the voltage applying section 9, the charging potentials of the toner particles are uniformized in a similar manner as mentioned above.

As is apparent from the above description, due to the formation of the electric field in the spaces 6*b* and 4, a thin toner layer having a uniform thickness containing only toner particles charged with a sufficient, uniform potential is formed on the developer roller 2. Due to the uniformity in the charging potential and the thickness of the toner layer on the developer roller 2 and also influenced by the electric field formed in the space 8, the charging potential of the toner particles and the thickness of the toner layer on the photoconductive drum 7 can both be uniform. As a result, images with a stable, uniform quality can be obtained.

Example 8

Figure 8:
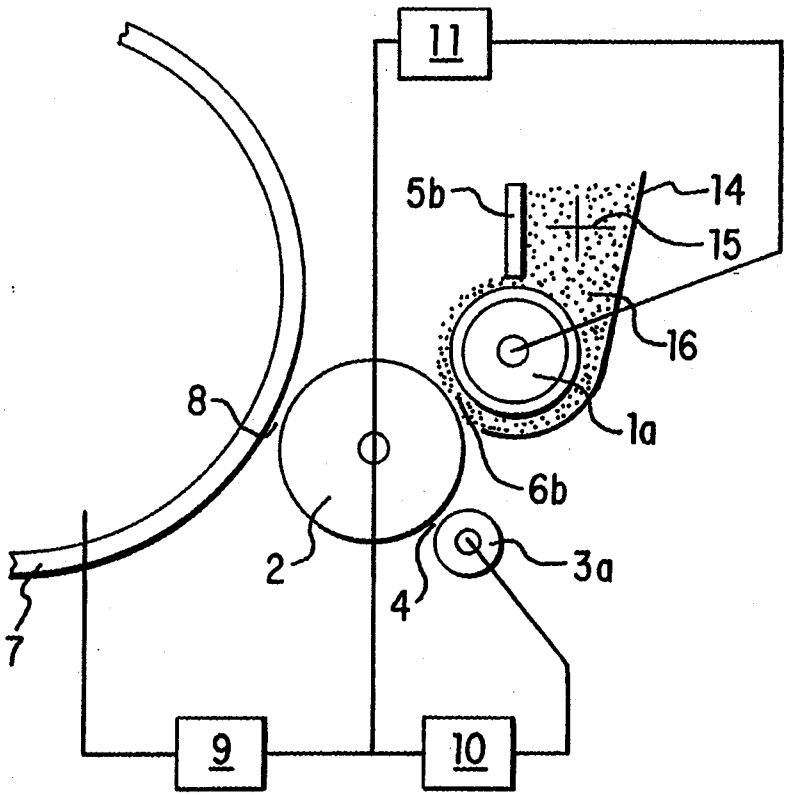
FIG. 8 is a view illustrating a construction of a developing device according to an eighth example of the present invention together with a photoconductive member.

FIG. 8 illustrates a construction of a developing device according to an eighth example of the present invention. In the eighth example, a two-component developer 16 is used.

The developing device according to the eighth example is distinct from that in the seventh example in that a conductive roller 3*a* is provided instead of the conductive plate 3.

Since the other sections and members are identical with those in the seventh example, description will be omitted. Needless to say, the function and the effects of the developing device according to the eighth example are the same as those in the seventh example.

In the seventh and the eighth examples, the doctor blade 5*b* in contact with the magnetic roller 1*a* may have other shapes, for example, the one shown in FIG. 9A or 9B. The doctor blade 5*b* may be formed of a rubber-like elastic material or a resin.

As is apparent from the above eight examples, when developing is performed by a developing device according to the present invention, only a certain amount of toner particles which are sufficiently charged are selected and moved from the first developer retaining member to the second developer retaining member. Accordingly, only the toner particles which are sufficiently charged adhere to the photoconductive drum.

Further, in the case where a DC voltage, an AC voltage or a voltage obtained by superposition of a DC voltage and an AC voltage is applied between the second developer retaining member and a conductive member provided in the vicinity of the second developer retaining member, the toner particles collide with one another in the toner layer on the second developer retaining member, thereby uniformizing the charging potentials of the toner particles. Accordingly, even in the case when the developing device is used in repetition, the toner particles which adhere to a latent image formed on the photoconductive drum are uniformly and constantly charged in a toner layer having a uniform thickness. This stabilizes image density. In an image forming apparatus equipped with such a developing device, images with a uniform density are constantly obtained for a long period of time.

Moreover, such a developing device normally functions under the condition that a toner layer containing only toner particles charged with a uniform potential is formed on the second developer retaining member. Therefore, the developer supplied to the first developer retaining member is not only limited to a monocomponent developer or two-component developer, but any other developer such as a 1.5-component developer may be used. This advantage allows a developing device according to the present invention to be commonly used in a developing section of various electrophotographic apparatuses. Accordingly, the developing devices as well as other parts for use in various electrophotographic apparatuses can be of an identical type, which lowers the production cost.

Further, a developing device according to the present invention, for which a colored non-magnetic toner can be used, that can be applied to a color electrophotographic apparatus.

Example 9

Figure 10:
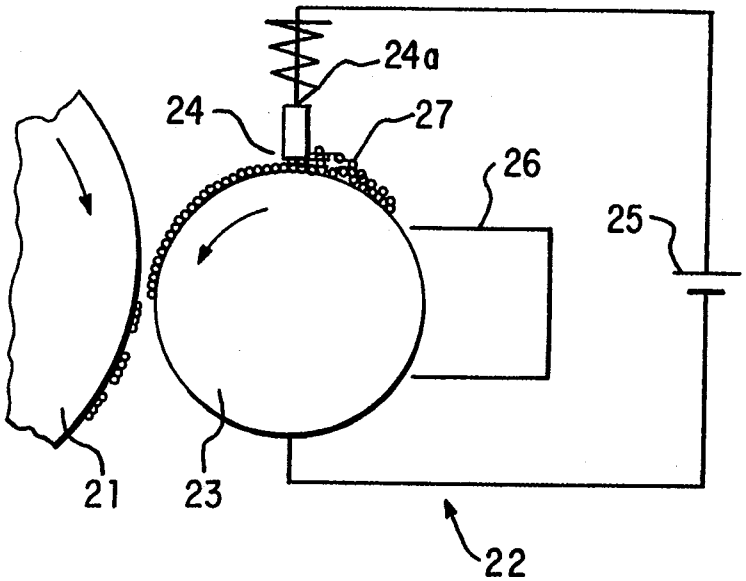
FIG. 10 is a view illustrating a construction of a developing device according to a ninth example of the present invention together with a photoconductive member.

A developing device according to a ninth example of the present invention is illustrated in FIG. 10.

A developing device 22 is opposed to a photoconductive drum 21. The developing device 22 includes a developer roller 23 as a developer retaining member, a blade 24, a power supply 25, and a developer accommodating section 26. The developer accommodating section 26 accommodates a monocomponent developer 27 formed only of a toner.

The developer 27 used in the developing device according to the ninth example is a non-magnetic toner mainly containing a resin such as styrene acrylic resin mixed with a colorant such as carbon, and the toner particles have an average grain size of 7 μm, which is smaller than that of generally used toner particles. (Particles of a toner generally used have an average grain size of approximately 9 to 10 μm.) The toner particles used in the ninth example have a resistivity of $4\times10^{10}$ Ωcm so as to be charged positive by friction with the blade 24. The resistivity of the toner particles is preferably $10^{13}$ Ωcm or less.

In the ninth example, the developer roller 23 is formed of a conductive material such as aluminum and has a cylindrical shape. The blade 24 is formed of urethane rubber having a resistivity of $1\times10^{8}$ Ωcm and a thickness of 2 min. The blade 24 is pressure-contacted on the developer roller 23 by a loading member 24*a* at a specified pressing force. The pressing force is preferably set to be approximately 1.5 kgf/cm$^2$ or less, and is set to be 400 gf/cm$^2$. The developer roller 23 and the blade 24 are connected to the power supply 25. The power supply 25, which is a DC power supply, applies the side of the blade 24 with a voltage having an identical polarity with that of the charge applied to the toner particles (positive in the ninth example). The level of the voltage to be applied by the power supply 25 is appropriately determined by the resistivity of the developer 27, the pressing force of the blade 24, the resistivity of the blade 24, and other elements.

The relationship among these elements, the voltage applied by the power supply 25, and the charge applied to the developer 27 (hereinafter, referred to as the toner) will be described with reference to FIGS. 11 and 12.

Figure 11:
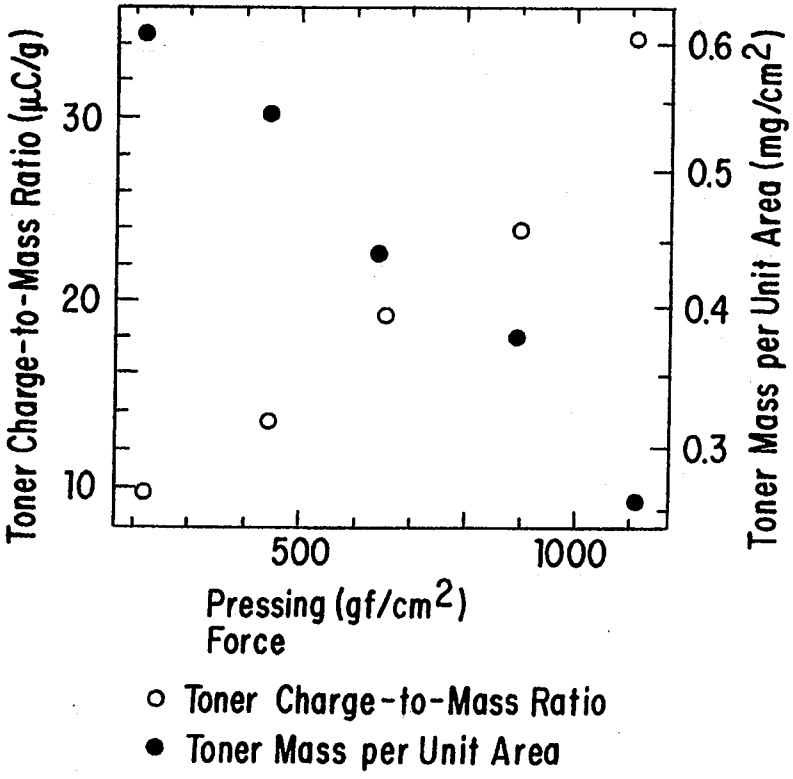
FIG. 11 is a graph showing the relationship among the pressing force of a blade, the amount of toner which adheres to a developer retaining member, and the toner charge-to-mass ratio (μC/g).

FIG. 11 shows the relationship among the pressing force of the blade 24, the toner mass per unit area which adheres to the developer roller 23, and the amount of electricity of the charged toner per unit mass (namely, the toner charge-to-mass ratio). As is apparent from FIG. 11, when the pressing force applied to the toner by the blade 24 is small, the amount of toner which adheres to the developer roller 23 is large. However, since less friction occurs between the toner and the blade 24 in such a case, the toner charge-to-mass ratio is insufficient. Generally, an appropriate amount of toner which adheres to a developer roller (the amount of toner required for developing) is considered to be approximately 1 mg/cm$^2$ and an appropriate toner charge-to-mass ratio is considered to be approximately 10 μC/g. As is shown in FIG. 11, in order to obtain the appropriate toner charge-to-mass ratio (10 μC/g), the pressing force of the blade 24 is required to be approximately 200 gf/cm$^2$. In this case, the amount of toner which adheres to the developer roller 23 is only approximately 0.6 mg/cm$^2$. Such an insufficient amount of toner which adheres to the developer roller 23 causes the density of an image to be too low. By contrast, if the pressing force of the blade 24 is lowered (to a level not shown in FIG. 11) in order to raise the amount of toner which adheres to the developer roller 23 to approximately 1 mg/cm$^2$, the toner charge-to-mass ratio becomes too small. This causes, for example, the following problems: (a) the toner scatters; and (b) since the blade 24 cannot form the toner into a sufficiently thin layer and the toner charge is small, the toner floats from the developer roller 23. As is apparent from the above description, it is difficult to supply a toner having a sufficient charge in a sufficient amount by only adjusting the pressing force of the blade 24

Figure 12:
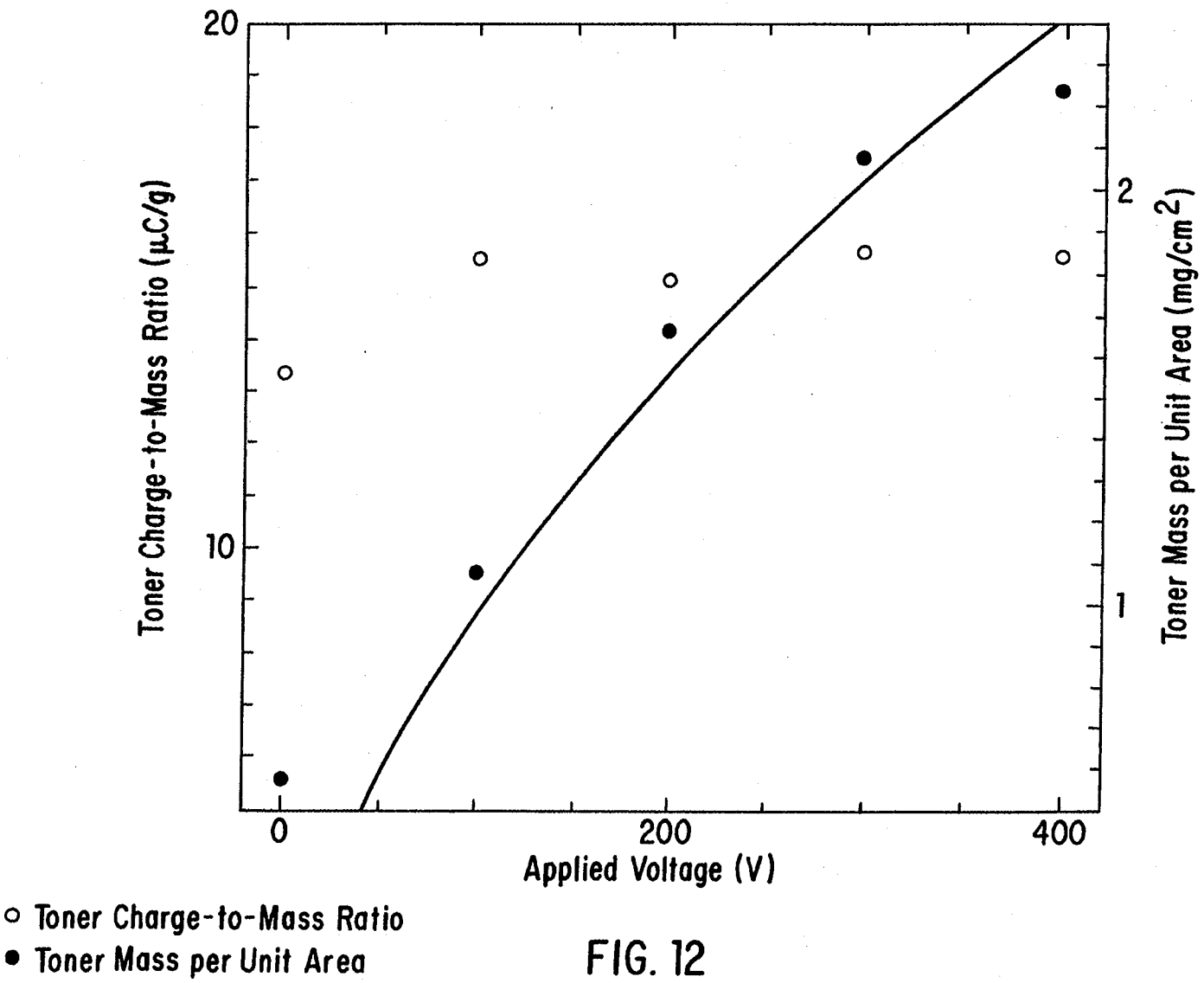
FIG. 12 is a graph showing the theoretical curve and experimental results indicating the relationship among the voltage applied to the blade, the amount of toner which adheres to a developing retaining member, and the toner charge-to-mass ratio (μC/g).

FIG. 12 is a graph showing the relationship between the toner mass per unit area of the toner retaining member and the toner charge-to-mass ratio when a voltage is applied to the blade 24. The white and black circles show the results of an experiment, and the curve is the theoretical curve. The theoretical formula of the toner mass per unit area w when a voltage Vi is applied to the blade 24 is obtained as follows.

The relationship between the surface potential Vs of the toner layer and the toner mass per unit area w is expressed by Equation (1).

$$w = \sqrt{\frac{2\epsilon_0 P\{1 + P(\epsilon_t - 1)\}}{\delta} \frac{V_S}{(q/m)}} \quad (1)$$

The voltage Vt applied to the toner layer when the voltage Vi is applied to the blade 24 is expressed by Equation (2).

$$V_t = \frac{R_t \cdot l_t}{R_b \cdot l_b + R_t \cdot l_t} V_i. \quad (2)$$

The toner mass per unit area w is considered to increase until the surface potential Vs of the toner layer becomes equal to the voltage Vt. Accordingly, where Vs=Vt, the toner mass per unit area w is expressed by Equation (3).

$$w = P\left\{\frac{-R_b \cdot l_b + \sqrt{R_b^2 \cdot l_b^2 + 4R_t^2 \cdot A \cdot V_i}}{2R_i}\right\} \quad (3)$$

"A" in Equation (3) is expressed by Equation (4).

$$A = \frac{2\epsilon_0\{1 + P(\epsilon_t - 1)\}}{\delta P} \frac{1}{(q/m)} \quad (4)$$

where $\epsilon_0$: permittivity in the vacuum,
$\epsilon_t$: relative permittivity of toner layer,
P: filling ratio (concentration) of toner,
$\delta$: true density of toner,
q/m: toner charge-to-mass ratio,
$R_b$: resistivity of blade,
$l_b$: thickness of blade,
$R_t$: resistivity of toner,
$l_t$: thickness of toner layer The pressing force of the blade 24 and other elements are appropriately set as mentioned above. As the voltage is raised, the amount of toner which adheres to the developer roller 23 is gradually increased. In the ninth example, an appropriate toner mass per unit area (1 mg/cm$^2$) is obtained at the voltage of approximately 100 V, and the toner charge-to-mass ratio is also sufficient (15 $\mu$C/g). As is apparent from this, the amount of toner which adheres to the developer roller 23 and the toner charge-to-mass ratio are both increased by simultaneously pressing the developer roller 23 by the blade 24 and applying a voltage. When the pressing force of the blade 24 is 400 gf/cm$^2$, the amount of toner Which adheres to the developer roller 23 is only approximately 0.5 mg/cm$^2$ to 0.6 mg/cm$^2$ with no voltage application but is approximately 1 mg/cm$^2$ with voltage application. Such a phenomenon is considered to occur because: (a) the toner is charged by friction with the blade 24 and by charge injection from the blade 24; and further (b) the toner is attracted by a voltage applied between the blade 24 and the developer roller 23 toward the side of the developer roller 23, the electric sign of whose potential is opposite to that of the toner. For these reasons, the amount of toner which adheres to the developer roller 23 is increased.

In the case where the pressing force of the blade 24 exceeds 1.5 kgf/cm$^2$ or where the resistivity of the toner exceeds $10^{13}$ $\Omega$cm, the amount of toner which adheres to the developer roller 23 does not increase even if a voltage is applied. The pressing force of the blade 24 is preferably between 100 gf/cm$^2$ and 1 kgf/cm$^2$, and the resistivity is preferably $10^{13}$ $\Omega$cm or less as mentioned above. In FIG. 12, the toner charge-to-mass ratio is kept at a satisfactory level even if the amount of toner which adheres to the developer roller 23 is increased. This is considered to occur because the adverse effect brought on the toner charge is compensated for by the charge injection from the blade As has been described so far, the amount of toner which adheres to the developer roller 23 can be increased without lowering the toner charge-to-mass ratio, by applying a voltage in a state where the pressing force of the blade 24 is kept small. By performing developing in such a state, images having a sufficient density are obtained.

In the ninth example, the toner containing particles having a grain size of approximately 7 $\mu$m is used. In a conventional developing device, a sufficient image density cannot be obtained with such small toner particles. By contrast, according to the present invention, a sufficient image density can be obtained with such small toner particles.

In the ninth example, the developer roller 23 is formed of aluminum, and the blade 24 is formed of a conductive urethane rubber material. In the case where the developer roller is formed of a conductive urethane rubber material and the blade is formed of a metal, identical effects are obtained.

In a developing device according to the ninth example of the present invention, the amount of toner which adheres to the developer roller can be increased without lowering the toner charge-to-mass ratio, so as to develop an image with a sufficient amount of toner. Accordingly, images having an appropriate density can be obtained. By applying the side of the blade with a voltage having an identical polarity with that of the charge of the toner, the toner particles which are sufficiently charged are promoted so as to move to the developer roller, and the toner particles which are not sufficiently charged are prevented from moving to the developer roller. Since the toner charge-to-mass ratio is not lowered, toner scatter and accordingly blur are prevented.

Example 10

Figure 13:
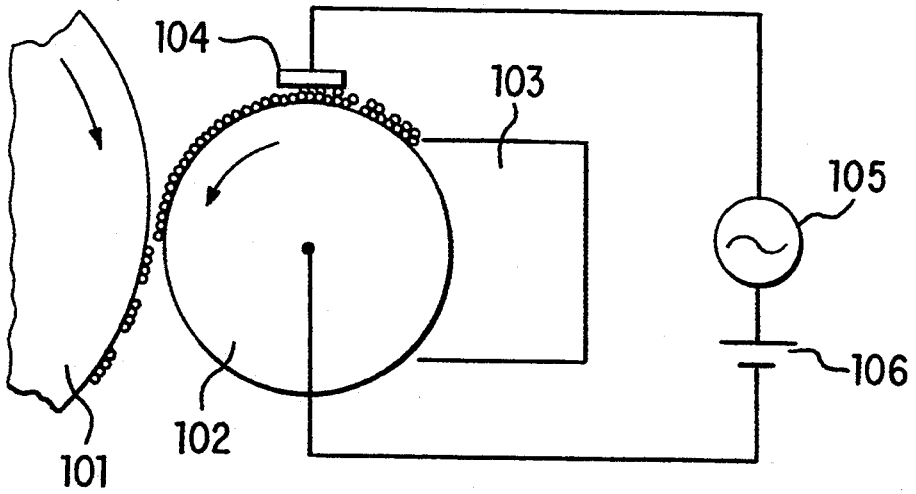
FIG. 13 is a view illustrating a construction of a developing device according to a tenth example of the present invention together with a photoconductive member.

A developing device according to a tenth example of the present invention is illustrated in FIG. 13.

A photoconductive drum 101 has known photoconductivity. A developer roller 102 as a developer retaining member is provided so as to be opposed to the photoconductive drum 101. A region where the photoconductive drum 101 and the developer roller 102 are opposed to each other acts as a developing section. The developer roller 102 is formed of a conductive material such as aluminum. The developer roller 102 is shaped as a cylindrical drum in the tenth example, but may be a belt or the like. The photoconductive drum 101 and the developer roller 102 rotate as indicated by arrows in FIG. 13. A toner supply section 103 is provided in the vicinity of the developer roller 102, on the opposite side from the photoconductive drum 101. In the toner supply section 103, toner particles of a monocomponent developer are charged and adhere to the developer roller 102. The toner particles may be charged by friction with a blade (not shown), charge injection or any other arbitrary method.

The toner supplied from the toner supply section 103 is transported toward the developing section by the rotation of the developer roller 102.

Figure 15:
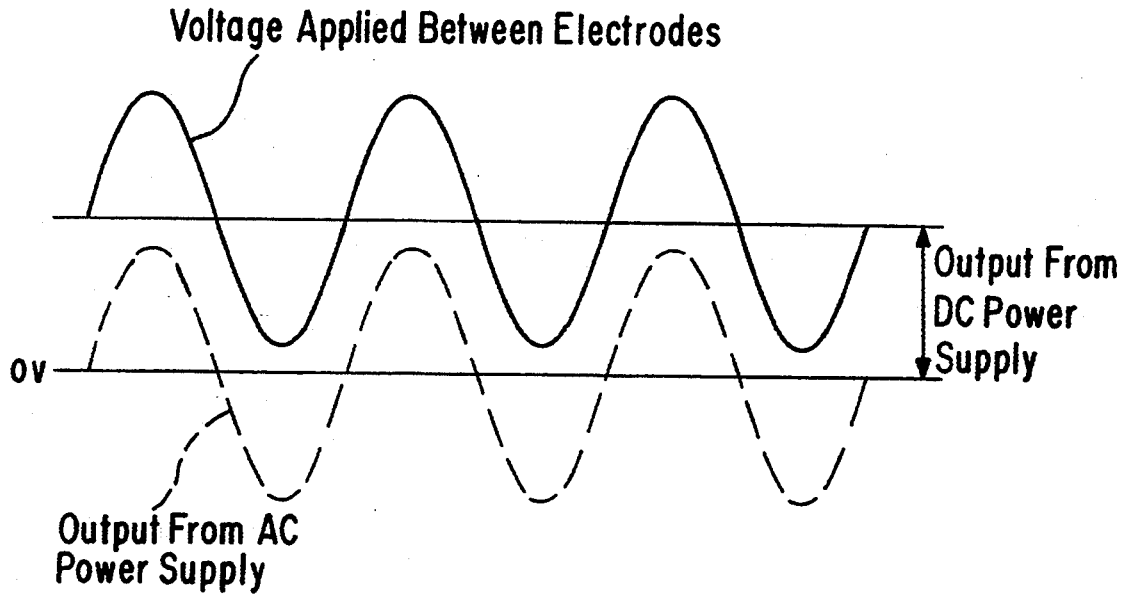
FIG. 15 is a view showing a state of the voltage applied between the electrode section and a developer retaining member.

An electrode section 104 is provided between the toner supply section 103 and the developing section to be opposed to the developer roller 102. The electrode section 104 is a conductive plate extended in an axial direction of the developer roller 102. The developer roller 102 is formed of a conductive material. An AC power supply 105 and a DC power supply 106 are connected in series between the developer roller 102 and the electrode section 104 in a direction in which the electric current flows. In the tenth example, the toner is charged so as to be positive, and the DC power supply 106 is connected to charge the side of the electrode section 104 to be positive. By such polarity setting, an AC voltage is biased to be positive by a DC voltage as is shown in FIG. 15.

Figure 14:
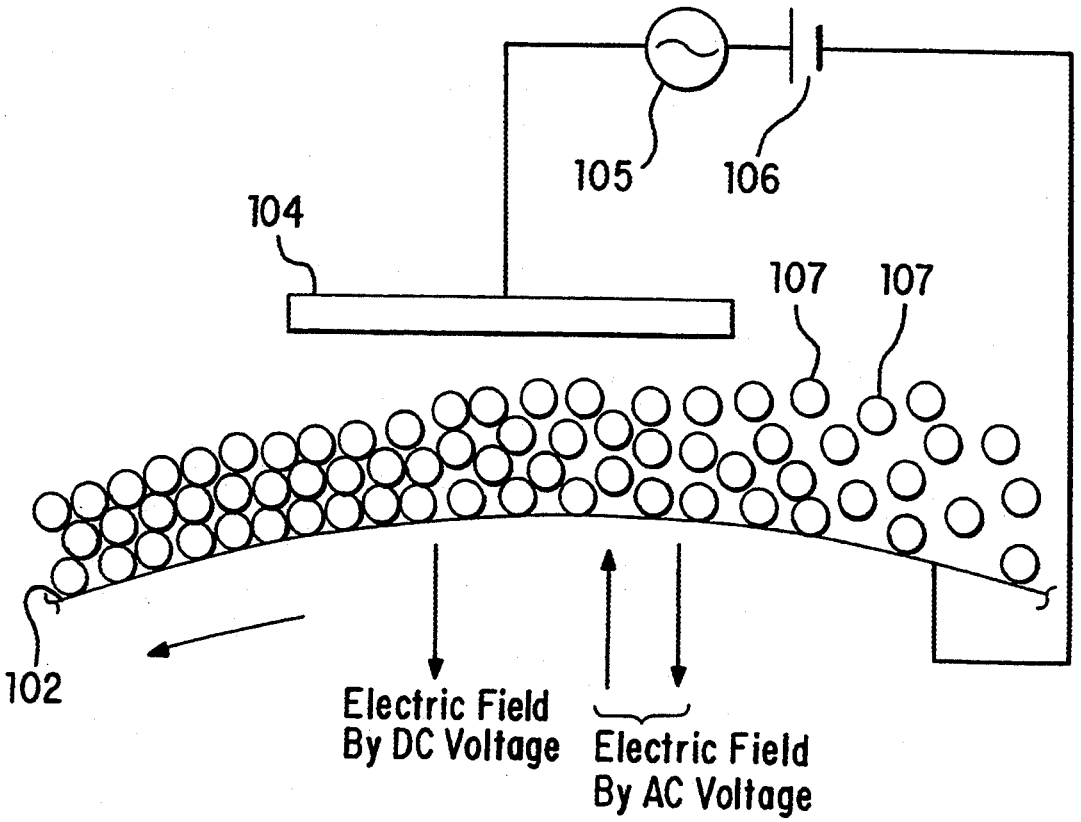
FIG. 14 is an enlarged view of an electrode section of the developing device shown in FIG. 13.

FIG. 14 shows an enlarged view of the electrode section 104 and the vicinity thereof. An AC voltage and a DC voltage are applied between the electrode section 104 and the developer roller 102. The AC power supply 105 applies the positively charged toner 107 with an electric field in such directions so as to cause the toner particles to reciprocate between the electrode section 104 and the developer roller 102. The DC power supply 106 applies the toner 107 with an electric field in such a direction so as to cause the toner particles to repel against the electrode section 104 and to be attracted to the developer roller 102. In such a state, the toner 107 charged positive is attracted to the developer roller 102 by the DC voltage while reciprocating between the developer roller 102 and the electrode section 104. In this manner, the toner particles more and more tightly fill a surface of the developer roller 102.

A practical example will be described.

The distance between the developer roller 102 and the electrode section 104 was set to be approximately 0.25 mm, and the AC power supply 105 and the DC power supply 106 were set to output 1.0 kV (amplitude) and 0.2 kV, respectively, so as to apply these voltages to the toner 107 on the developer roller 102 for several seconds. Then, a surface potential of the toner 107 (the potential of the toner 107 on the developer roller 102) before the toner 107 passed by the electrode section 104 and such a surface potential after the toner 107 passed by the electrode section 104 were compared. The potential of the toner 107 before the toner 107 passed by the electrode section 104 was approximately 60 V, but was reduced to approximately 40 V after the toner 107 passed by the electrode section 104. No toner adhered to the electrode section 104, and the amount of toner on the developer roller 102 did not change. The toner charge-to-mass ratio after the toner 107 passed by the electrode section 104 did not change from the value obtained before the toner 107 passed by the electrode section 104.

Generally, a surface potential is expressed by Equation (5).

$$V_t = \frac{q}{m} \cdot \frac{1}{2\epsilon_0\epsilon_t} \cdot \delta P Z^2 = \frac{q}{m} \cdot \frac{1}{2\epsilon_0\epsilon_t} \cdot \frac{\omega^2}{\delta P} \tag{5}$$

where $V_t$: surface potential, q/m: toner charge-to-mass ratio, $\epsilon_0$: permittivity in the vacuum, $\epsilon_t$: relative permittivity of toner layer ($\epsilon_t = 1 - P \div P.\epsilon_T$), $\epsilon_T$: relative permittivity Of toner, $\delta$: true density of toner, P: filling ratio (concentration) of toner, Z: thickness of toner layer, $\omega$: toner mass per unit area ($\omega = \delta PZ$)

From Equation (5), provided neither the amount of adhering toner ($\omega$) nor the toner charge-to-mass ratio (q/m) changes, the reduction in the surface potential of the toner 107 on the developer roller 102 is caused by an increase in the filling ratio (P) of the toner 107. The filling ratio (P) is expressed by Equation (6).

$$P = \frac{1}{2(\epsilon_T - 1)} \cdot \left\{ -1 + \sqrt{1 + 2(\epsilon_T - 1) \cdot \frac{1}{\epsilon_0\delta} \cdot \frac{q}{m} \cdot \frac{\omega^2}{Vt}} \right\} \tag{6}$$

When the filling ratio (P) changes, the thickness of the toner layer changes even if the amount of the toner 107 on the developer roller 102 is kept the same. The thickness of the toner layer is expressed by Equation (7).

$$Z = \frac{\omega}{\delta P} \tag{7}$$

Accordingly, for example, where the toner charge-to-mass ratio q/m=10 $\mu$C/g, the relative permittivity of toner $\epsilon_T$=2.2, the toner mass per unit area $\omega$=1 mg/cm$^2$ and the true density of toner $\delta$=1 g/cm$^3$ the change in the surface potential $V_t$ from approximately 60 V to approximately 40 V corresponds to a change in the filling ratio P from approximately 56% to approximately 74% and a change in the thickness of the toner layer from approximately 18 $\mu$m to approximately 14 682 m. The thickness of the toner layer is reduced.

A surface of the toner layer before the toner 107 passed by the electrode section 104 and the surface after the toner 107 passed by the electrode section 104 were observed by a metallurgical microscope and compared. The surface of the toner layer after being applied with a voltage by the electrode section 104 was tightly filled with the toner particles and was uniform in terms of charging potential and thickness.

In a developing device according to the tenth example, the toner particles are tightly filled in the toner layer and accordingly the thickness of the toner layer is reduced. Even in the case where a toner including toner particles having a small grain size is used, toner scatter or blur does not occur, and thus images having a high density are obtained.

Figure 16:
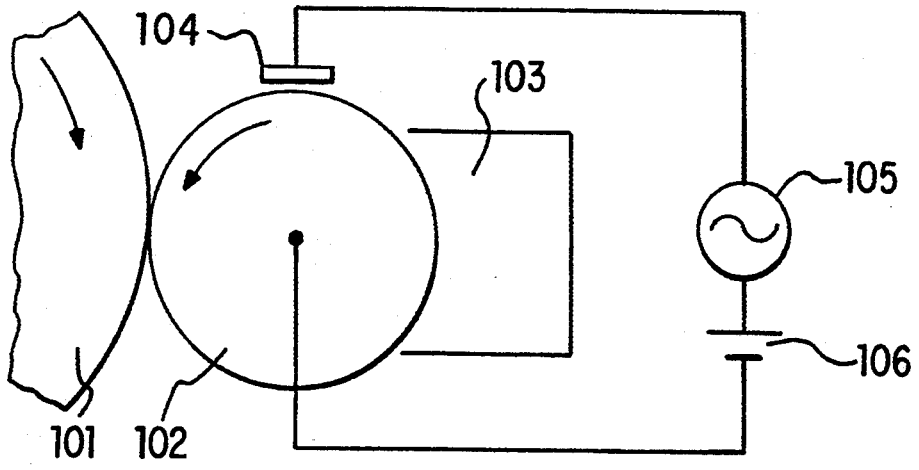
FIG. 16 is a view illustrating a construction of a developing device according to a modification of the tenth example of the present invention together with a photoconductive member.

In FIG. 13, the developer roller 102 and the photoconductive drum 101 are out of contact from each other. As is shown in FIG. 16, the developer roller 102 and the photoconductive drum 101 may be in contact with each other with the other parts being identical with those in FIG. 13.

Figure 17:
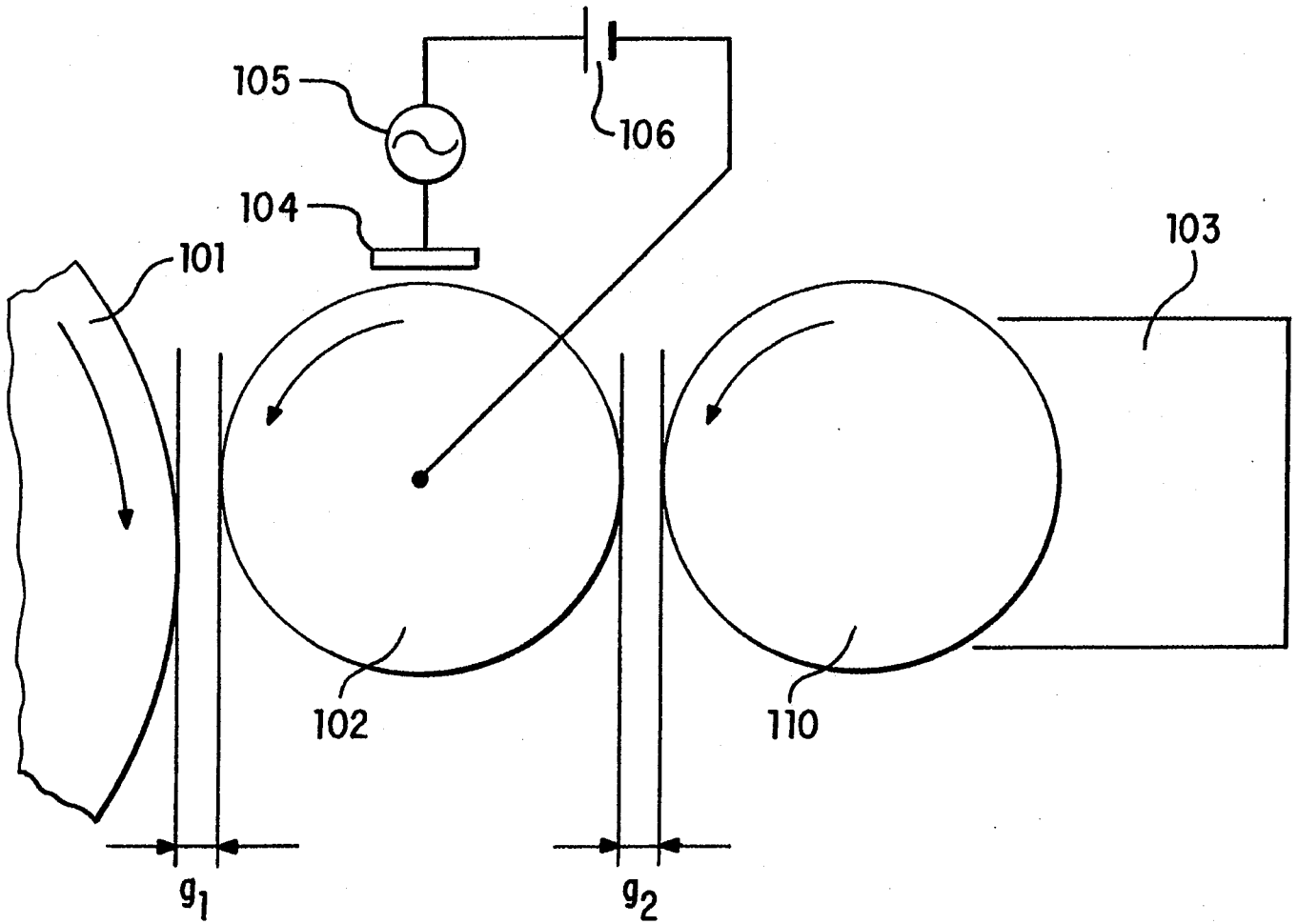
FIG. 17 is a view illustrating a construction of a developing device according to another modification of the tenth example of the present invention together with a photoconductive member.

As is shown in FIG. 17, another developer roller 110 may be provided in the vicinity of the developer roller 102, on the opposite side from the photoconductive drum 101. In such a case, the photoconductive drum 101 and the developer roller 102 may have a space g1 therebetween or may be in contact with each other. The developer rollers, 102 and 110 may have a space g2 therebetween or may be in contact with each other.

The electrode section 104 is a plate in the tenth example, but may have an arched cross section to be provided along the developer roller 102 or may be a roller. The developer roller 102 may have a flat shape such as a belt. The output of the AC power supply 105 may have a sinusoidal waveform, a square waveform, a triangular waveform or a pulse waveform.

In a developing device according to the tenth example of the present invention, since a toner layer having a high filling ratio is formed on the developer roller, a sufficient amount of toner can be obtained even with a thin toner layer. Accordingly, even in the case where a toner containing toner particles having a small grain size is used, images having a high density can be obtained with no toner scatter or blur. Such advantages realize formation of images having a high resolution.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A developing device for developing, by using a developer, a latent image formed on a surface of an image data forming member, comprising:

a developer accommodating section for accommodating the developer;

a first developer retaining member for receiving the developer from the developer accommodating section and transporting the developer;

a second developer retaining member for receiving the developer from the first developer retaining member and making the developer adhere to the latent image formed on the image data forming member;

a conductive member opposed to the second developer retaining member with an appropriate space interposed therebetween, the conductive member being disposed upstream with respect to the image data forming member in the rotating direction of the second developer retaining member;

first voltage applying means for applying a voltage between the first developer retaining member and the second developer retaining member;

second voltage applying means for applying a voltage between the second developer retaining member and the surface of the image data forming member; and third voltage applying means for applying a voltage between the second developer retaining member and the conductive member in order to form an electric field in the space therebetween.

2. A developing device according to claim 1, wherein the first voltage applying means applies one of a DC voltage, an AC voltage and a voltage formed by superposition of a DC voltage and an AC voltage.

3. A developing device according to claim 1, wherein the second voltage applying means applies one of a DC voltage, an AC voltage and a voltage formed by superposition of a DC voltage and an AC voltage.

4. A developing device according to claim 1, wherein the third voltage applying means applies one of a DC voltage, an AC voltage and a voltage formed by superposition of a DC voltage and an AC voltage.

5. A developing device according to claim 1, wherein the developer is a monocomponent developer formed of a non-magnetic toner.

6. A developing device according to claim 1, wherein the developer is a two-component developer containing a non-magnetic toner.

7. A developing device according to claim 6, wherein the developer accommodating section includes stirring means for stirring the developer.

8. A developing device according to claim 1, wherein at least one of the first developer retaining member and the second developer retaining member is a roller.

9. A developing device according to claim 1, wherein at least one of the first developer retaining member and the second developer retaining member is a belt.

10. A developing device according to claim 1, wherein the conductive member is a roller.

11. A developing device according to claim 1, wherein the conductive member is a plate having an arched cross section.

12. A developing device according to claim 1, further comprising at least one blade opposed to the first developer retaining member, the blade forming the developer transported by the first developer retaining member into a thin layer.

13. A developing device according to claim 12, wherein the blade regulates a thickness of the thin layer of the developer.

14. A developing device according to claim 1, wherein the conductive member is disposed downstream with respect to the first developer retaining member.

15. A developing device according to claim 1, wherein the conductive member makes a potential of the developer on the second developer retaining member uniform.

16. A developing device according to claim 1, wherein the first developer retaining member is substantially in contact with the second developer retaining member.

17. A developing device according to claim 1, wherein the first developer retaining member is disposed apart from the second developer retaining member.

18. A developing method, for developing, by using a developer, a latent image formed on a surface of an image data forming member, comprising:

a first step of transporting a developer by a first developer retaining member to a second developer retaining member; and a second step of transporting the developer by the second developer retaining member to the surface of the image data forming member so as to make the developer adhere to the latent image thereon, wherein, at least in the first step, a voltage is applied between the first developer retaining member and the second developer retaining member; and wherein, at least in the second step, a voltage is applied between the second developer retaining member and the surface of the image data forming member and between the second developer retaining member and a conductive member opposed to the second developer retaining member with an appropriate space interposed therebetween, and the conductive member, which is disposed upstream with respect to the image data forming member, charges the developer which is transported between the first developer retaining member and the image data forming member in a rotating direction of the second developer retaining member.

19. A developing method according to claim 18, wherein a potential of the developer on the second developer retaining member is made uniform by the voltage applied between the second developer retaining member and the conductive member.

* * * * *

UNITED STATES PATENT AND TRADEMARK OFFICE

CERTIFICATE OF CORRECTION

ATENT NO. : 5,416,567

ATED : May 16, 1995

NVENTOR(S): Toyoshima et al.

It is certified that error appears in the above-identified patent and that aid Letters Patent is hereby corrected as shown below:

In column 7, line 34, "roller i" should read -- roller 1 --.

In column 7, line 39, -- 11, -- should be inserted between "applying section" nd "thereby".

In column 7, line 54, "rollers i" should read -- rollers 1 --.

In column 14, line 28, "2 min" should read -- 2 mm --.

In column 16, line 32, "the blade" should be -- the blade 24 --.

In column 18, line 25, "$(\epsilon_t = 1 - P \div P . \epsilon_T)$" should be $(\epsilon_t = 1 - P + P \cdot \epsilon_T)$.

In column 18, lines 59-60, "14 682m" should read -- 14 $\mu$m --.

Signed and Sealed this

Twenty-second Day of August, 1995

Bruce Lehman

*Attest:*

BRUCE LEHMAN

*Attesting Officer*

*Commissioner of Patents and Trademarks*